US005224296A

United States Patent [19]

Brignon

[11] Patent Number: 5,224,296

[45] Date of Patent: Jul. 6, 1993

[54] DOOR WITH SEVERAL SLIDING PANELS

[76] Inventor: Francois Brignon, 12, rue Detaille, 93250 Villemonble, France

[21] Appl. No.: 820,641

[22] PCT Filed: Jul. 23, 1990

[86] PCT No.: PCT/FR90/00559

§ 371 Date: Jan. 21, 1992

§ 102(e) Date: Jan. 21, 1992

[87] PCT Pub. No.: WO91/01427

PCT Pub. Date: Feb. 7, 1991

[30] Foreign Application Priority Data

Jul. 21, 1989 [FR] France ..... 89 09895

[51] Int. Cl.[5] ..... E05D 15/20

[52] U.S. Cl. ..... 49/130; 49/217; 49/218; 49/222

[58] Field of Search ..... 49/130, 216, 217, 218, 49/219, 222

[56] References Cited

U.S. PATENT DOCUMENTS

| | | | |
|---|---|---|---|
| 4,551,945 | 11/1985 | von Resch | 49/130 X |
| 4,669,219 | 6/1987 | Tomida | 49/130 |
| 4,794,730 | 1/1989 | Fishbach | 49/130 |
| 4,949,504 | 8/1990 | Bortoluzzi | 49/130 |
| 4,976,066 | 12/1990 | Plummer et al. | 49/219 X |

FOREIGN PATENT DOCUMENTS

| | | |
|---|---|---|
| 156698 | 10/1985 | European Pat. Off. . |
| 201717 | 11/1986 | European Pat. Off. . |

*Primary Examiner*—Philip C. Kannan

*Attorney, Agent, or Firm*—Sandler, Greenblum & Bernstein

[57] ABSTRACT

Door provided with a door frame, and at least one mobile panel having a top and a bottom. The mobile panel is capable of displacement between a closed position where the mobile panel is in place in the door frame and an open position where the mobile panel is moved aside with respect to the closed position, and the mobile panel passes from one to the other of these two positions by lateral displacement in a lateral direction from the closed plane to the opening plane and sliding in the opening plane. There are also provided a lower complementary guidance rail; at least one sliding unit, positioned at the bottom of the mobile panel and associated with the lower complementary guidance rail, unit carrying the mobile panel in the open position; a mechanism for guiding and holding of the mobile panel with respect to the door frame positioned on top of the mobile panel, a mechanism for enabling the relative displacement of the sliding unit and mobile panel in the lateral direction between an inside position and an outside position; and support means on a bottom part of the door frame for supporting the mobile panel in the closed position.

19 Claims, 6 Drawing Sheets

DOOR WITH SEVERAL SLIDING PANELS

BACKGROUND OF THE INVENTION

1. Field of the Invention

The present invention is directed to a sliding door with several panels in which an open panel can be placed in front of a closed panel.

2. Discussion of Background Information

French Patent Nos. 2053406, 2126621, 2438728, 2475615, 2420443, French addition certificate 2250011 and European addition certificate 85400375 describe sliding doors or parts of sliding doors having various disadvantages. For example, large forces are necessary for maneuvering heavy and high doors, premature deterioration occurs in casters which skid, guiding systems have a large bulk, and, on vehicles undergoing geometric variations, discontinuities in heat insulation, airtightness and water-tightness occur.

EP-201717 has also proposed doors intended to be vertical both in their open position and in their closed position and which are connected for this purpose to sliding units which are coupled to them by connection means which are deployed both at the top part and the bottom part of the door frame. However, the door structures proposed in EP-201717 would be difficult to produce for doors with large dimensions. Further, the means of connection between the sliding units and the panel would in this case, in fact, be very highly stressed. Furthermore, these doors would not be very easy to operate.

SUMMARY OF THE INVENTION

The present invention will be described with the door closed, wherein all of the panels are located in the same plane, called the closed plane, against the door frame. The first opening phase consists in a displacement which separates the panel from its door frame and places it in another plane called the opening or rolling plane, located parallel to the closed plane. The second opening phase consists in a displacement of the panel in the opening plane, which allows the passage to be opened by placing the open panel in front of a closed panel.

In order to clarify the description of the invention, it has arbitrarily been considered that a closed panel is located on the inside and conversely that an open panel is located on the outside.

Furthermore, between the inside closed plane and the outside opening plane, a displacement from one to the other is called lateral. A displacement in the opening plane is called longitudinal.

The single lower rail includes no curves, cavities or protuberances, it is rectilinear and its cross section is reduced to the width necessary to allow the crossing of two casters, one connected to the closed panel and the other connected to the open panel moving in the rolling plane.

A panel comprises two casters which are connected to it at the bottom by a mechanical device. The casters are offset by a variable distance towards the inside with respect to the main plane of the panel. The variation is allowed by the connecting mechanism depending on whether the panel is pushed laterally towards the inside or pulled towards the outside during maneuvers.

The door frame comprises fixed support points intended to support the bottom part of the closed panel. These support points are disposed in such a way that the panel is located slightly raised, so that its casters no longer bear on the bottom rail. These support points are also disposed so that the panel is in a state of imbalance directed towards the inside.

When the panel is in the outside position, the connecting mechanism of each caster is deployed and the panel is then greatly offset towards the outside with respect to the points of contact of the casters with the rail. The panel is then unbalanced towards the outside.

When the panel is pushed towards the inside, the mechanical connection of each caster shortens simultaneously, the bottom of the panel engages on the fixed supports and the casters lose contact. The panel is displaced a little more on the fixed supports and the casters are then simultaneously displaced laterally without touching the rail and therefore without skidding.

When the panel arrives in the closed plane, it assumes the state of imbalance directed towards the inside.

Thus, the top part of the panel has force applied from the inside or from the outside in a way which favors the maneuver performed.

The top part of the panel comprises one or more guidance devices. Each upper guidance device comprises a support connected to the panel, including an arm and a rod whose ends are connected to the support by articulations whose axes are vertical, this arm and the rod, which can be housed inside their support constitutes a triangulation once deployed.

The other end of the arm opposite the articulation comprises a vertical prolongation called a finger. This finger is engaged in the upper part of the door frame whose inside face cooperates with the guidance finger of the open panel. A certain pressure of the finger on the inside guidance face is ensured by the state of imbalance, towards the outside, of the open panel.

This pressure also ensures the deployment of the arm and of the upper guidance rod, which corresponds to the vertical position of the open panel.

During the rolling phase, the movements of the finger, resulting from accidental lateral displacements of the panel which is poorly guided during the rolling, are limited by a prolongation located at the top part of the panels that are still closed. This prolongation is only active in this configuration. One of the support faces of the arm is placed in the same plane as that of the top part of the panel, and thus ensures the continuity of the guidance of the finger.

The closing maneuver having the effect of moving the panel from the outside position to the inside position generates a thrust of the top part of the panel towards the inside. That is to say the end of the arm, by means of the finger which prolongs it, enters into contact with the face of the door frame. The thrust thus produced has the effect of pivoting the arm and the rod about their respective vertical axis. The arm and the guidance rod move aside and place themselves in the plane of the panel which is then closed. This moving aside of the arm may not be total, it is related to the residual distance which remains between the closed panel and the door frame, and depends on the horizontal seals which are not part of the present invention.

The vertical joinings, claimed in the present invention, are different from one side to the other of each panel.

One of the sides, called the front side, comprises a joining device in the form of a tongue which cooperates with a groove produced in the door frame.

The tongue situated in the prolongation of the panel, and in its principal plane, comprises at its end a cylindrical swelling. The groove produced in the upright of the door frame has its opening facing the other upright. The depth of the groove allows the tongue to be received with its cylindrical swelling, leaving it free to slide and to rotate partially. Free spaces, formed on either side of the tongue and at the bottom of the groove, allow the reception of seals having a large deflection.

The other upright, called the rear upright, of the panel is fitted with a system of two fillisters. This arrangement is provided symmetrically on the door frame upright or on the rear upright of another panel which is closed and therefore located in the closed plane.

The closing of the panel is carried out by firstly engaging the tongue in the groove. In this configuration the panel is slightly oblique. The panel is then capable of pivoting about the vertical axis of the swelling of the tongue, doing this in the manner of an ordinary swinging door pivoting about the axis of its hinges. In this way the second panel upright fitted with fillisters can be pushed towards the inside in the direction of closure until it meets its counterpart located in the closed plane.

This fillister receives a substantially corrugated seal which ensures the sealing by several contact generatrices.

In order to close, it is necessary to carry out a lateral displacement of the panel on the tongue side which results from the combination of the lateral movements allowed by this device connecting the caster to the panel and by the displacement of the panel on its support with a longitudinal movement allowing the tongue to be engaged in the groove. The displacement of the other side of the panel necessary for crossing the leaves is obtained by the lateral displacement allowed by the connecting device and the support. The movements carried out in the opposite order correspond to the opening.

The subject of the present invention is therefore a door comprising at least one mobile panel capable of displacement between a closed position where the panel is in place in its door frame and an open position where the panel is moved aside with respect to its closed position and is located in an outside plane offset with respect to the inside closed plane, the panel passing from one to the other of these two positions by lateral displacement from the closed plane to the opening plane and sliding in the opening plane, the bottom of the panel being provided with at least one sliding unit associated with a lower complementary guidance rail, the top of the panel also being associated with upper means of guidance and holding of the panel with respect to the door frame, the open position and the closed position of the panel being two substantially vertical positions, the bottom part of the panel being carried in the open position by the sliding unit or units whose means of connection to the bottom of the panel are deployed and in thrust, characterized in that the bottom of the panel is carried, in the closed position, by support means on the bottom part of the door frame and in that the panel is, in the open and closed positions, unbalanced towards the outside and towards the inside respectively, the top of the panel being held, in this unbalanced position, by the support of upper means of guidance on walls of the top part of the door frame.

Advantageously, the means of connection of a sliding unit to the bottom of a panel comprise rods articulated with respect to the panel and to the sliding unit in such a way as to form a deformable parallelogram, the articulation axes being substantially horizontal axes and parallel to the plane of the panel, such that the open and closed positions of the panel are positions of stable imbalance.

Preferably, the panel is, in the opening position, bearing on the sliding unit or units disposed on the inside with respect to the principal plane of the panel, such that the imbalance thus produced ensures the bearing of its upper means of guidance and holding on one wall of the top part of the door frame. Advantageously, the abovementioned means of guidance and holding comprise at least one arm articulated near one of its ends to the top of the panel and pivoting about a substantially vertical spindle, the arm being provided at its other end with a prolongation protruding with respect to the arm towards the top of the door frame and intended to come into contact with the abovementioned wall of the door frame, the arm being capable of pivoting between a position in which it is substantially moved aside with respect to its door frame and an open position which is oblique with respect to the plane of the panel towards the inside of the door frame, at the level of which the arm is blocked in its pivoting by the intermediary of end stop means.

Preferably, the end stop means comprise a rod mounted such that it pivots with respect to the panel about a spindle which is substantially parallel to the pivoting spindle of the abovementioned arm, one of the arm or the rod being provided with a groove extending partially over its length, the other being provided with a complementary spindle or stud cooperating with the groove in such a way that during the pivoting of the arm, the stud slides in the groove and drives the rod such that it pivots, the pivoting of the arm being limited by the stopping of the stud on the end walls of the groove. Advantageously, an arm is mounted such that it pivots about its axis on a support having a U-shaped cross-section whose open part is directed towards the inside of the door frame, the base of the support being substantially parallel to the plane of the panel, the support receiving the arm in its moved aside position, its upper branch being provided with a notch into which the prolongation associated with the arm fits.

Also advantageously, the wall of the door frame on which a panel bears by the intermediary of its upper means of guidance and holding in the opening position is provided, at least partially on one of its lengths, with a relief in the shape of a hook directed upwards, which cooperates with a hook-shaped notch directed downwards, with which the prolongation is provided, the maximum of correspondence between the relief and a notch being obtained when the arm carrying the prolongation of the notch is in its extreme open position with respect to its panel.

A sliding element is, preferably, a guidance caster supporting the panel on which the lower guidance rail and the door frame allow the crossing of two moving panels; the door frame comprises, at its bottom part, supports intended to carry a panel in the closed position, the casters then no longer being stressed by the panel.

Again advantageously, the door also comprises means of sealing between two panels intended to be in the extension of one another in the closed position and/or between a panel and the door frame, these means of sealing comprising a tongue extending in the thickness of the door frame or of a panel over at least part of its height, the end of the tongue being substantially protruding and being intended to cooperate with a complementary groove which according to the case is provided in the complementary panel or door frame, the sealing means also comprising seals with a large deflection in contact with the facing thicknesses of the panels or of a panel and the door frame.

A prolongation can also be connected to the top part of the panel by a deformable parallelogram connection similar or identical to a connection of the deformable parallelogram type between a sliding unit and the bottom of the said panel.

BRIEF DESCRIPTION OF THE DRAWINGS

The invention will now be described in more detail with reference to embodiments and drawings in which.

DETAILED DESCRIPTION OF THE PREFERRED EMBODIMENTS

Figure 1:
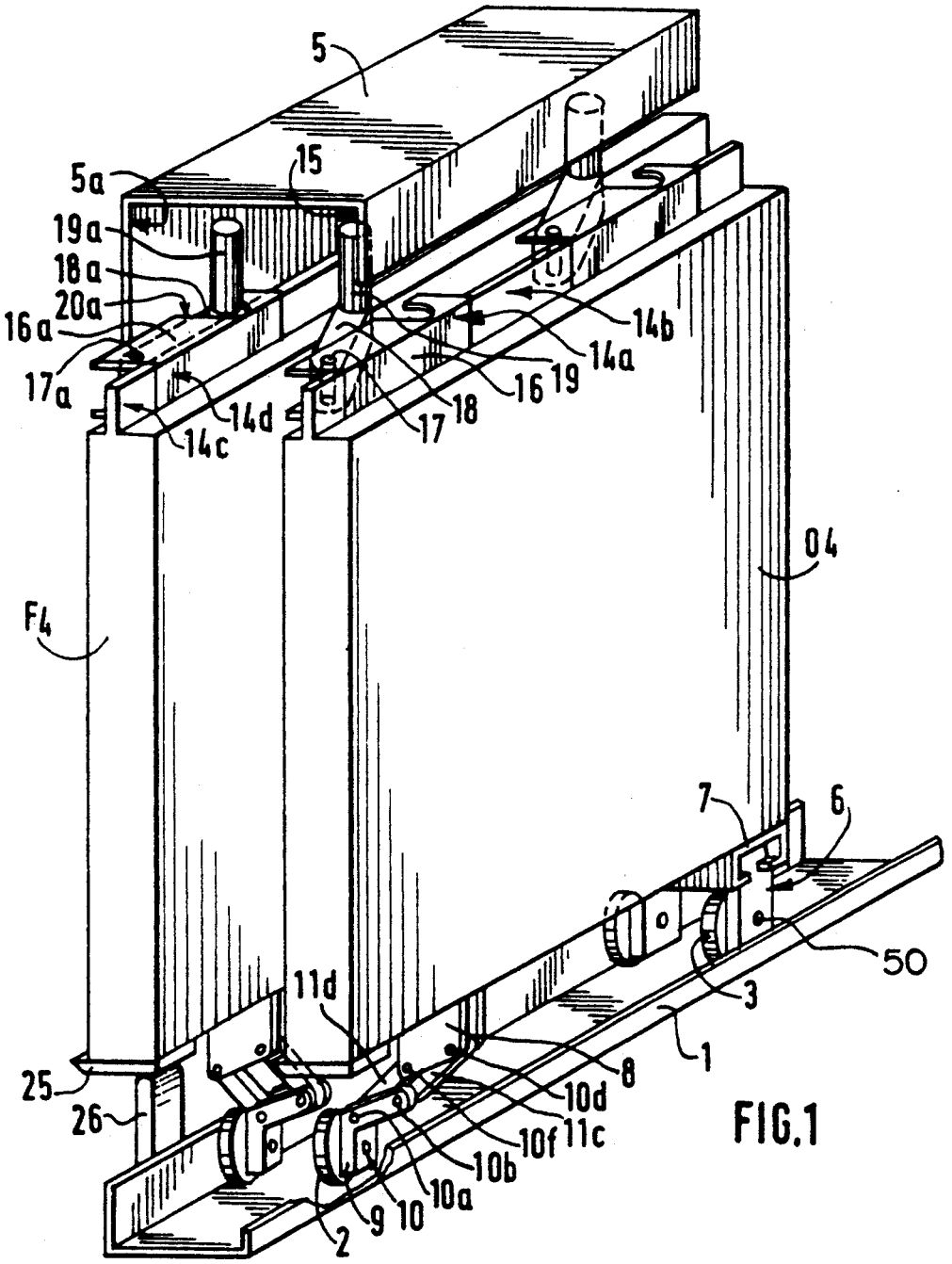
FIG. 1 is an overall view of a panel sliding in front of a closed panel.

FIG. 1 shows an open panel in line with which is a closed panel.

In the following explanations the panel is considered, according to the requirements of the descriptions, as resulting from the lateral displacement of the panel to the closed panel position or as a permanently closed panel in front of which moves another panel which has come into the rolling plane.

Figure 2:
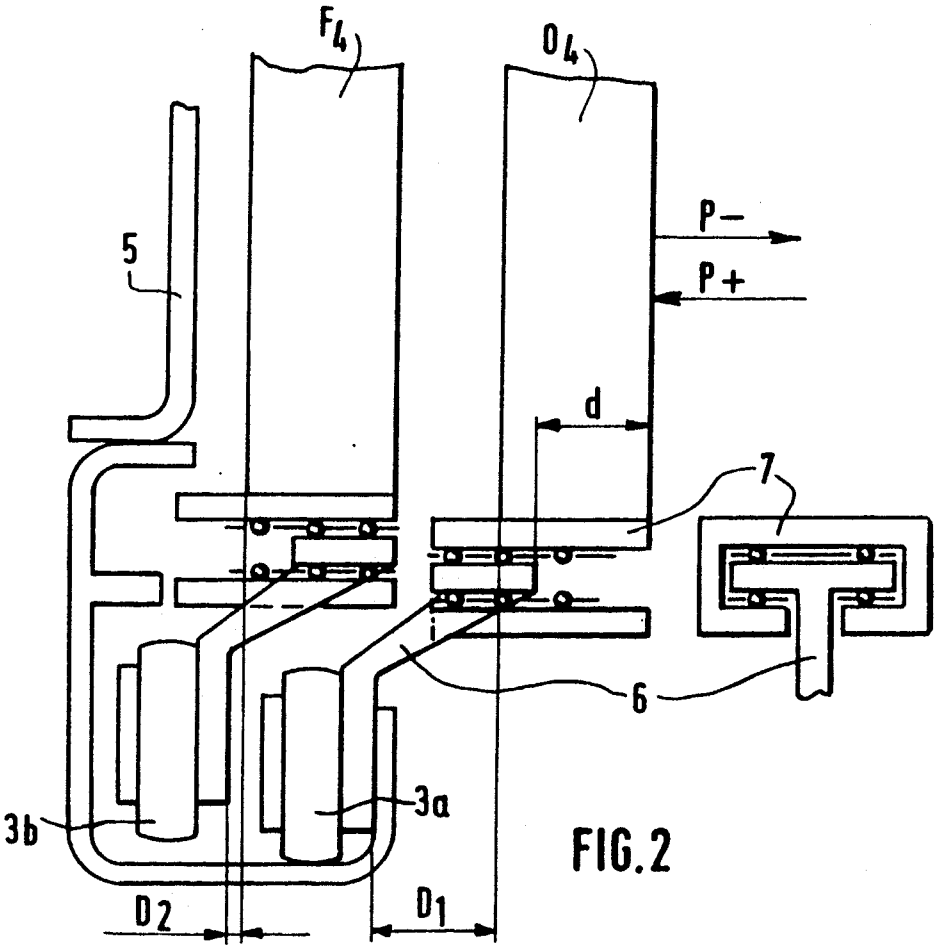
FIG. 2 shows an example of a mechanical connection between caster and panel.
Figure 4:
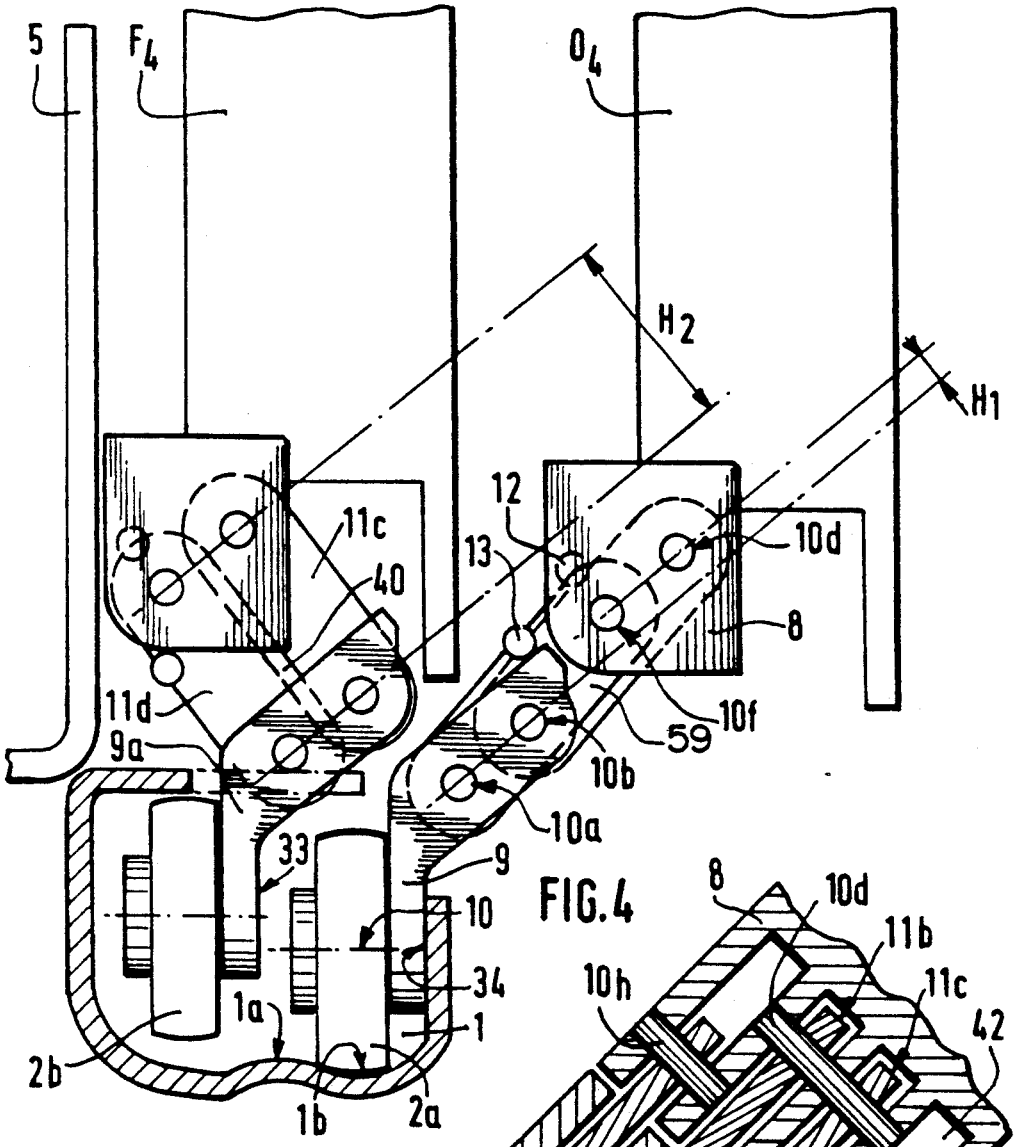
FIGS. 4 and 4*a* show the mechanical connection between caster and panel by deformable parallelogram.
Figure 4A:
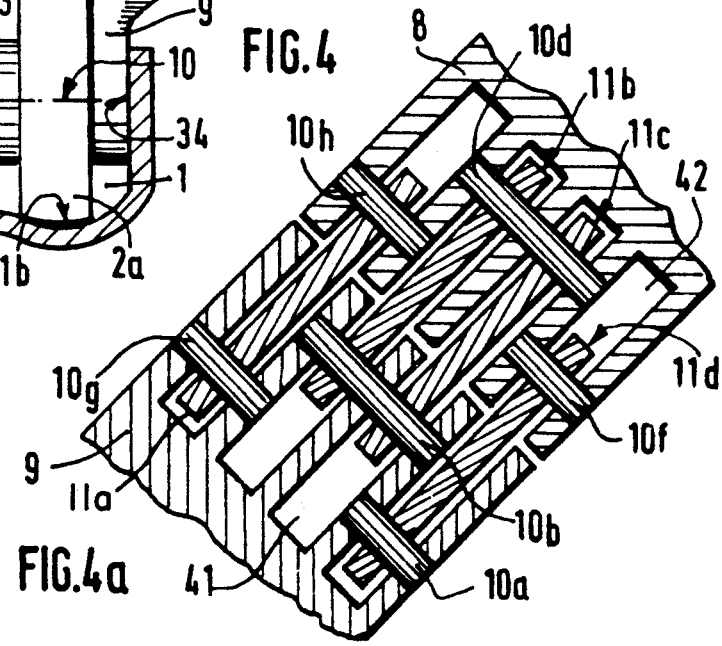

In FIG. 1, in order to show equivalences, the function of connection of the two casters has been shown by two different systems: the caster (2) is connected to the panel (04) by the system shown in FIGS. 4 and 4*a*, the caster (3) is connected to the panel (04) by the system shown in FIG. 2.

The caster (2) is connected to the panel (04) by a deformable parallelogram formed from a fork (9), two rods (11*d*, 11*c*), respectively connected to the fork (9) by the spindles (10*a*, 10*b*) and to the fork (8) by the spindles (10*f*, 10*d*). The fork (8) is connected to the panel (04) and the fork (9) supports the caster (2) by the spindle (10). It can be seen in FIG. 4*a*, that for reasons of sturdiness, rods (11*a*) and (11*b*) duplicate the rods (11*c*) and (11*d*), and spindles (10*g*) and (10*h*) are coaxial with spindles (10*a*) and (10*f*), respectively.

The caster (3) in FIG. 1 is shown connected to the panel (04) by the intermediary of a spindle (50) connected to the male part (6) of a slide cooperating with the female part (7).

The panel (04) rests on the rail (1) by the intermediary of the casters (2 and 3). It therefore has an imbalance towards the outside, the top part tending to separate from the door frame. The panel (04) is held, at the top part, in the vertical position by the action of the arms (18) whose end (19) bears on the guidance face (15) connected to the door frame (5). The arm (18), articulated about the vertical spindle (17), has come out of its support (16) forming an angle with the principal plane of the panel (04). This angle can be limited in a way described below. The panel (04) can thus be displaced by rolling on its casters (2, 3) while being held vertical at the top part by the prolongation (19) which cooperates with the face (15).

The support (16) is connected to the panel (04) in such a way that the face (14*a*) is coplanar with the face (14*b*) forming part of the panel. In the same way the closed panel (F4) has a continuous face (14*c*, 14*d*). This ensures an obstacle-free passage to the prolongation (19) in the event of the panel (04) undergoing a push capable of compensating the operational imbalance of the open panel position.

The closed panel (F4) rests on supports (26) by the intermediary of ramps (25) connected to the bottom part of the panel (F4). In this position the top part of the closed panel (F4) is unbalanced towards the inside and tends to approach the door frame (5). Because of this the prolongation (19*a*) bears on the face (5*a*) of the door frame (5).

The effect of this is to keep the arm (18*a*), which is able to pivot about the spindle (17*a*), housed in the support (16*a*) which is U-shaped. The prolongation (19*a*) is simultaneously housed in the opening (20*a*) of the support (16*a*).

Figure 3:
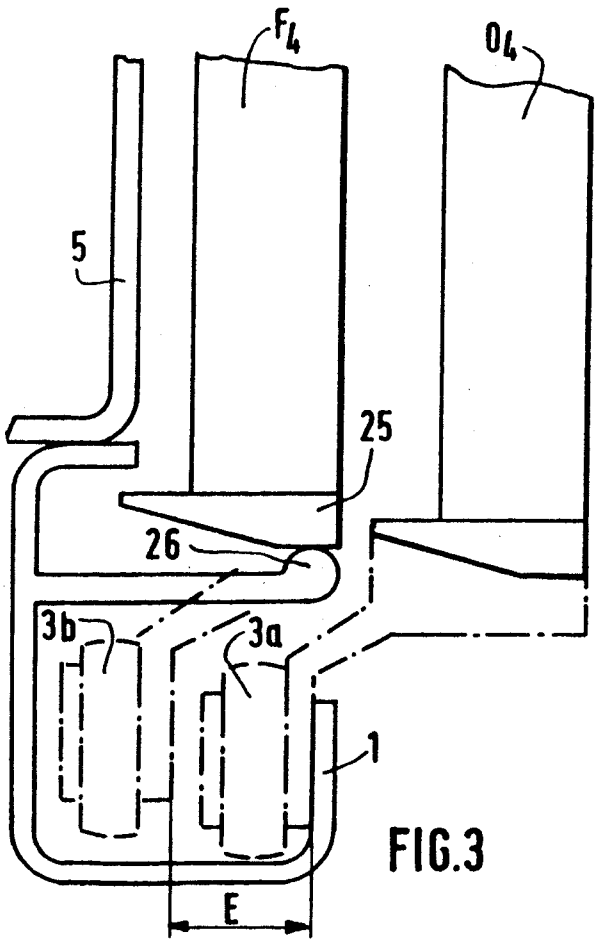
FIG. 3 shows resting of the panel in a closed position.

FIG. 2 shows that the mechanical connection between the caster (3*a*) and the panel (04), symbolized in this case by a male slide (6) which moves in the female part (7) allows, under the thrust (P+) a reduction in the distance (D1) to a value (D2). It can be seen that the difference $d = D1 - D2$ represents the travel of the slide. This allows, as seen in FIG. 3, the ramp (25) connected to the panel (F4) to engage on the support (26). The caster is therefore no longer loaded. The lateral displacement from the position of the caster (3*a*) to the position occupied by the caster (3*b*) has the value (E). This displacement occurs only when the ramp (25) and the support (26) cooperate and the caster (3*b*) is no longer bearing on the rail (1). The skidding of the caster is thus avoided. The total lateral displacement between the position of the panel (04) and that of the panel (F4) is therefore equal to: $d+E$. During the total displacement thus obtained by the thrust (P+) applied to the outside face of the panel (04), the supports change sides with respect to the vertical projection of the center of gravity of the complete panel, the top part of the panel (F4) tends to approach the door frame (5) and therefore in the same direction as the action (P+), the opening action (P−) produces the opposite effect.

FIGS. 4 and 4*a* show an embodiment using a deformable parallelogram which is specific to the present invention in order to provide, respectively, the connection between the caster (2*a*) or (2*b*) and the panel (04) shown in the open position or (F4) shown in the closed position. The caster (2*a*) is connected in rotation about the spindle (10) with the articulation part (9). The panel (04) also comprises an articulation part (8) in correspondence with the preceding one (9). The relative disposition of the articulation parts (8 and 9) and of the lines of the spindle holes (10*a*, 10*b*, 10*f*, 10*d*) is such that the general inclination of the order of 45° allows the caster (2*a*), in the position for moving in the rail (1), in the groove (1*b*), to pass under the articulation part (9*a*) relating to the closed position. The rail (1) can thus be reduced to a minimum width by limiting the distance between the face (33) and the face (34) to the minimum necessary to allow the movement of the caster (2*a*) and the necessary articulation part (9).

A set of two rods (11*a*, 11*d*) cooperates with the articulation parts (8 and 9) respectively by the intermediary of the spindles (10*h* and 10*f*) coaxial with each other and the spindles (10*g* and 10*a*) which are also coaxial with each other, the spindles (10*b* and 10*d*) connect the parts (9 and 8) to a second set of rods (11*b* and 11*c*), the housings (41, 42) such as those produced in the articulation parts (8 and 9) constitute volumes available exclusively for each of the rods (11*a*, 11*b*, 11*c* and 11*d*) which can thus pass each other, zones (59, 40), during movement.

The movement is limited to the position (H1) on opening by the stop piece (12), connected to the articulation part (8), acting on the rods (11*b*, 11*c*). This limitation is reinforced by the stop piece (13) connected to the rod (11*a*) acting on the articulation part (9).

During the closing, the thrust applied to the panel (04) is transferred to the rail (1) by the intermediary of the caster (2*a*) which is retained by the relief (1*a*).

The open panel (04) is then displaced towards the closed panel position (F4). The spindle (10*d*) and the spindles (10*f*, 10*h*) describe arcs of circles about their respective center lines which are the spindles (10*b*) and (10*a*, 10*g*), the trajectory of the articulation part (8) and of the bottom of the panel thus pass through a maximum height.

Because of this, the panel in going from (04) to (F4) during its closing therefore slightly rises and then descends again to stand on the fixed supports, which have already been described, in a position close to that of the closed panel (F4).

The set of rods (11*a*, 11*d*) can be of slightly different length from that of the other set of rods (11*b*, 11*c*) in order to cause the inclination of the caster (2*a*) during the closing movement and thus to improve the latter.

Figure 5:
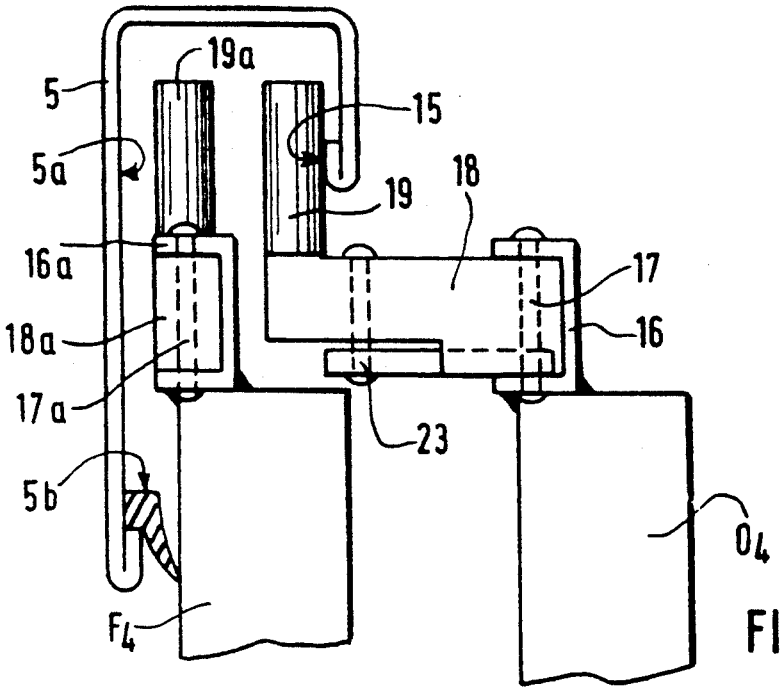
FIGS. 5 and 5*a* show the upper guidance device.
Figure 5A:
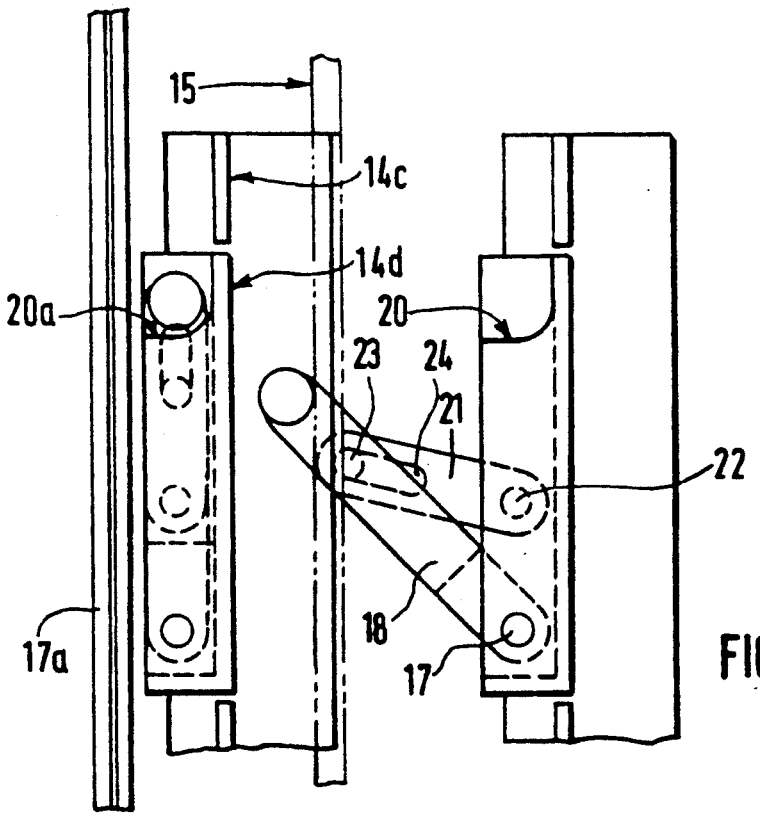

FIGS. 5 and 5*a* show an embodiment of an upper guidance device. It can be seen in the closed panel position (F4) that the prolongation (19*a*) is not in contact with the face (5*a*) of the door frame (5). The space thus produced allows the seal (5*b*) connected to the door frame (5) to become more or less crushed under the closing pressure of the panel (F4).

During the opening, the panel (F4) pushed towards the position (04) causes the prolongation (19) to press on the face (15). The pivoting of the arm (18) about the spindle (17) occurs up to a certain limit, determined in this case by the rod (21).

This rod (21) pivots about the spindle (22) at the same time as the arm (18). It is driven by the spindle (23) connected to the arm (18). The spindle (23) moves in the slot (24) of the rod (21) until it stops at the end of the slot (24). The deployment of the arm (18) is therefore stopped in the desired position in order that the panel (04) is held in the vertical position. During the sliding of the panel (04), the prolongation (19) and the end of the arm (18) are guided by the face (15), and possibly by the face (14*c*, 14*d*), in the case of disturbance of the movement of the panel. During the closing towards the panel position (F4), the action of the face (5*a*) will push the prolongation (19*a*) towards the housing (20*a*), thus the arm (18) and the rod (21) will reenter the inside of the support (16*a*).

Figure 6:
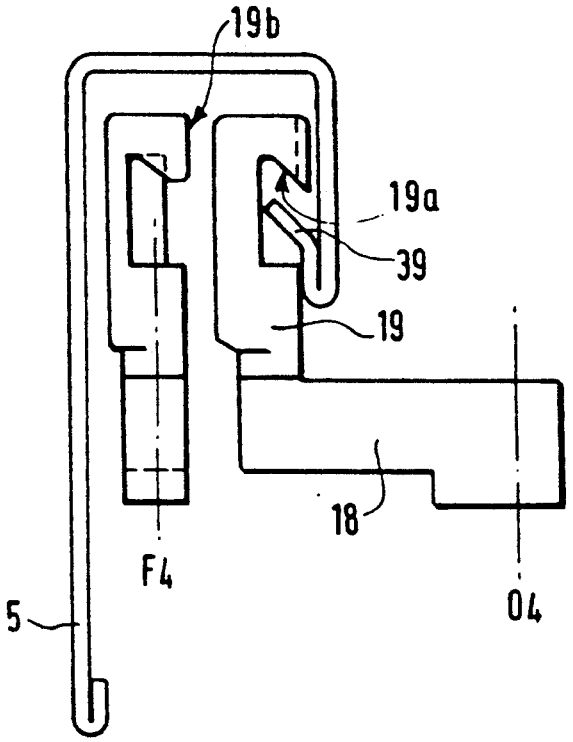
FIGS. 6 and 6*a* show the safety hook on the upper guidance device.
Figure 6A:
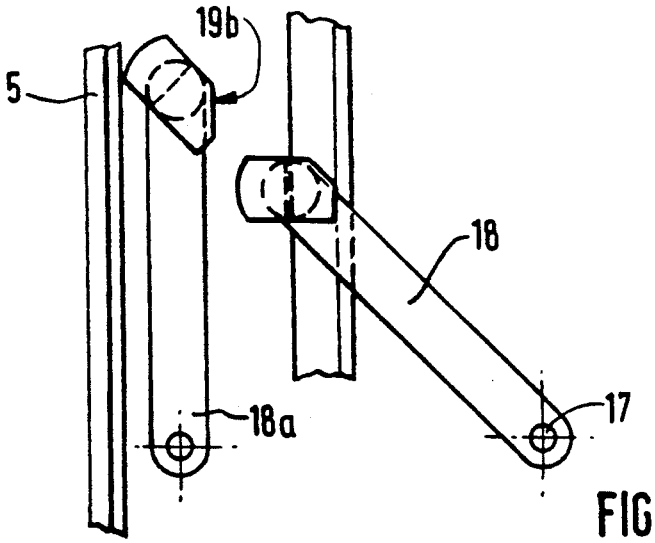

A variant of the guidance device is shown in FIGS. 6 and 6*a*. The door frame (5) comprises a hook-shaped oblique relief (39) over the entire guidance length. The prolongation (19) also comprises a hook-shaped notch (19*a*). The orientation of the notch (19*a*) is such that it is coupled in a parallel direction to the hook (39) when the arm (18) is in the open panel position (04). A chamfer (19*b*) contributes to the moving aside of the hook (19*a*) when the arm (18*a*) is in the closed position on a panel (F4).

The sealing device is provided so that each panel is closed in two stages:

1st stage: engagement of the sealing system associated with one of the vertical edges of the panel. This edge is called the front edge.

2nd stage: engagement of the sealing system associated with the other vertical edge of the panel. This edge is called the rear edge.

Figure 8:
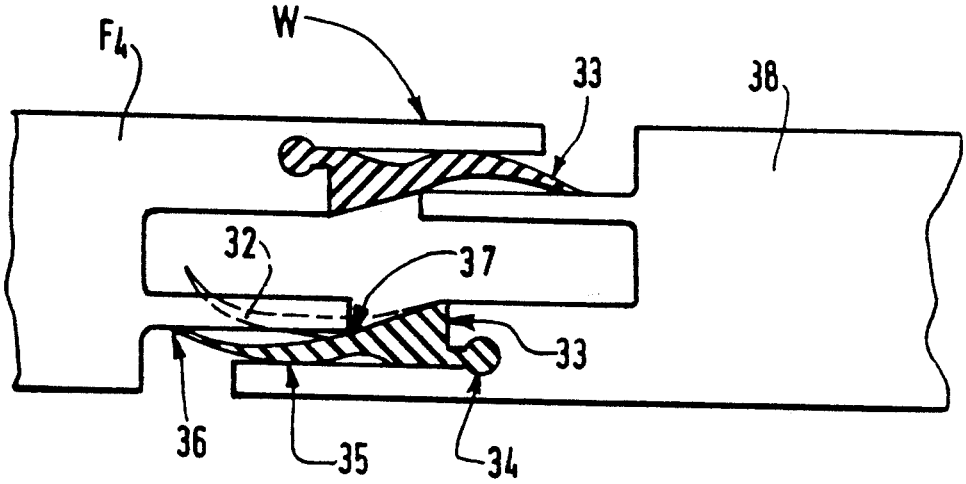
FIG. 8 shows the double fillister joining.
Figure 7:
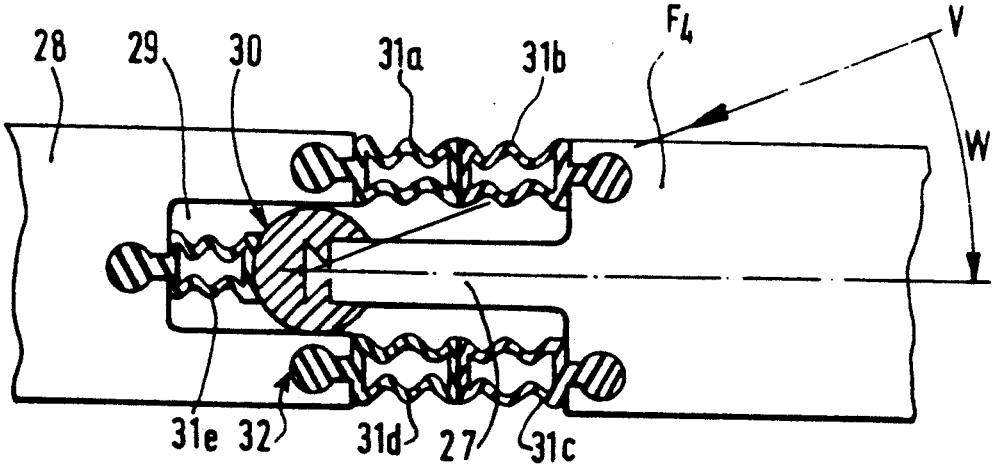
FIG. 7 shows the tongue with groove joining.

FIG. 7 shows the front edge of a closed panel (F4), the tongue (27) connected to the panel (F4) comprises a cylindrical prolongation (30) over the entire height of the panel. This prolongation (30) can slide or pivot in the groove (29) produced in the upright (28) of the door frame. During the closing of the panel (F4) the front edge, by its most forward element (30) can be engaged in an oblique manner (V) in the groove (29) without risk of jamming. FIG. 8 shows the rear edge of the panel (F4) closed on the upright (38) of the door frame by a movement of rotation (W), whose axis is located at the center of the cylinder (30), shown in FIG. 7.

In FIG. 7, the seal (31*e*) located at the bottom of the groove (29) and the seals (31*a*, 31*b*, 31*d* and 31*c*) disposed on either side of the tongue (27) and on each side of the groove (29) ensure the sealing, whatever the degree of engagement of the tongue (27) in the groove (29) may be.

In FIG. 8, each seal (33) occurs by a fillister system starting from the free shape (32) before the closing stress.

The shape of a seal (33) is such that in the stressed position it provides a connection (34) and a line of contact (35) with the upright (38) and two lines of contact (36) (37) with the closed panel (F4).

The upright (38) can be connected either to the door frame, or to a coupled panel without the principle thereby being modified.

As a variant, the connection device between the top of the panel (04) and the upper guidance (1) can be provided by the deformable parallelogram (9), (10*a*, *b*, *f*, *d*), (11*c*, *d*) and (8). The latter is mounted in the opposite direction in order to be symmetrical with that at the bottom. In this position, the caster (1) is not useful as it is the face (33) of the fork (9) which replaces the guidance finger (19).

I claim:

1. Door comprising:

a door frame;

at least one mobile panel having a top and a bottom, said at least one mobile panel being capable of displacement between a closed position where said at least one mobile panel is in place in said door frame and an open position where said at least one mobile panel is moved aside with respect to the closed position, the open position and the closed position of said at least one mobile panel comprising two substantially vertical positions defining an opening plane and a closed plane, respectively, and said at least one mobile panel passing from one to the other of these two positions by lateral displacement in a lateral direction from the closed plane to the opening plane and sliding in the opening plane;

a lower complementary guidance rail;

at least one sliding unit positioned at said bottom of said at least one mobile panel and associated with said lower complementary guidance rail, said at least one sliding unit carrying said at least one mobile panel in the open position;

means for guiding and holding of said at least one mobile panel with respect to said door frame positioned on said top of said at least one mobile panel, said at least one mobile panel is, in the open and closed positions, unbalanced towards the outside and towards the inside, respectively, and said top of said at least one mobile panel is held, in this unbalanced position, by said means for guiding and holding;

connection means associated with said at least one sliding unit for enabling the relative displacement of said at least one sliding unit and said at least one mobile panel in the lateral direction between an inside position where the plane of said at least one mobile panel is disposed towards said closed plane with respect to said at least one sliding unit, and an outside position where the plane of said at least one mobile panel is disposed towards said opening plane with respect to said at least one sliding unit; and support means on a bottom part of said door frame for supporting said at least one mobile panel in the closed position.

2. The door according to claim 1, wherein said connection means comprise rods articulated with respect to said at least one mobile panel and to said at least one sliding unit to form a deformable parallelogram, and substantially horizontal articulation axes which are substantially parallel to a plane passing through said at least one mobile panel, so that the open position and the closed position of said at least one mobile panel are positions of stable imbalance.

3. The door according to claim 1, wherein said means for guiding and holding comprise at least one first arm articulated near one end to said top of said at least one mobile panel for pivoting about at least one substantially vertical first spindle, and including a prolongation on another end capable of contacting a wall of said door frame, said at least one first arm being capable of pivoting against said top of said at least one mobile panel in the closed position and pivoting to an oblique position with respect to said plane passing through said at least one mobile panel.

4. The door according to claim 3, wherein said prolongation comprises a downwardly directed hook-shaped notch, and said wall of said door frame comprises a relief having a shape of an upwardly directed hook, and said hook-shaped notch and said relief having maximum correspondence when said at least first arm is in an extreme open position with respect to said at least one mobile panel.

5. The door according to claim 3, including means for stopping for blocking pivoting of said arm.

6. The door according to claim 5, wherein said means for stopping comprise a first rod mounted to pivot with respect to said at least one mobile panel about a second spindle which is substantially parallel to said pivoting spindle of said at least one first arm, one of said first arm or said first rod including a partially extending slot and the other of said first arm or said first rod including a complementary stud for cooperating with said slot, so that, during pivoting of said first arm, said stud slides in said slot and pivots said rod, and the pivoting of said rod is limited by stopping of said stud on end walls of said slot.

7. The door according to claim 6, including at least one support for said at least one first arm.

8. The door according to claim 7, wherein said at least one support has a U-shaped cross-section.

9. The door according to claim 8, wherein said U-shaped cross-section of said at least one support includes a base, an upper branch and a lower branch forming an open part, said open part of said U-shaped cross-section being directed towards the inside of said door frame, and said base being substantially parallel to said plane of said at least one first mobile panel, said at least one support being capable of receiving said at least one first arm in said inside position, and said upper branch including a notch into which said prolongation fits.

10. The door according to claim 1, wherein said at least one sliding unit comprises at least one guidance caster mounted on and supporting said at least one mobile panel, and said at least one guidance caster rolling in said guidance rail.

11. The door according to claim 10, wherein said guidance rail comprise a rectilinear guidance rail.

12. The door according to claim 10, wherein said guidance rail and said door frame enable crossing of two mobile panels.

13. The door according to claim 12, wherein said support means comprise at least one support for carrying at least one mobile door panel, so that casters on said at least one mobile door panel are not subject to stress.

14. The door according to claim 10, wherein said support means comprise at least one support for carrying at least one mobile door panel, so that casters on said at least one mobile door panel are not subject to stress.

15. The door according to claim 1, comprising means for sealing.

16. The door according to claim 15, wherein said means for sealing are positioned between at least one of two mobile panels intended to be an extension of each other in the closed position, and said at least one mobile panel and said door frame.

17. The door according to claim 16, wherein said means for sealing comprise a first tongue extending in a thickness of at least one of said door frame and at least part of a height of said at least one mobile panel, and a second tongue having an end substantially protruding from a complementary groove in a complementary mobile panel or said door frame.

18. The door according to claim 15, wherein said means for sealing comprise a first tongue extending in a thickness of at least one of said door frame and at least part of a height of said at least one mobile panel, and a second tongue having an end substantially protruding from a complementary groove in a complementary mobile panel or said door frame.

19. The door according to claim 18, wherein said means for sealing comprise seals having large deflection in contact with at least one of facing edges of mobile panels and a mobile panel and said door frame.

* * * * *